United States Patent [19]

Pro

[11] Patent Number: 4,505,473

[45] Date of Patent: Mar. 19, 1985

[54] CYCLE SUPPORT FOR EXERCISING

[76] Inventor: George M. Pro, 9307 Lee Blvd., Leawood, Kans. 66206

[21] Appl. No.: 598,400

[22] Filed: Apr. 10, 1984

Related U.S. Application Data

[63] Continuation of Ser. No. 339,625, Jan. 15, 1982, abandoned, which is a continuation of Ser. No. 136,173, Mar. 31, 1980, abandoned.

[51] Int. Cl.[3] ..... A63B 21/00

[52] U.S. Cl. ..... 272/73; 272/128

[58] Field of Search ..... 272/131, 134, 73, 128

[56] References Cited

U.S. PATENT DOCUMENTS

| | | | |
|---|---|---|---|
| 547,168 | 10/1895 | Hutson | 272/73 |
| 574,167 | 12/1896 | Ray | 272/73 |
| 2,972,478 | 2/1961 | Raines | 272/73 |
| 3,125,341 | 3/1964 | Carrington | 272/73 |

*Primary Examiner*—Richard C. Pinkham
*Assistant Examiner*—T. Brown
*Attorney, Agent, or Firm*—Schmidt, Johnson, Hovey & Williams

[57] ABSTRACT

An exerciser for simulating bicycling having a collapsible bicycle stand, provided with a flywheel for the storage of energy, rotatably supports an elevated flywheel spindle behind a rear, treadle-powered bicycle wheel such as to be driven through frictional engagement with the rear wheel tire only while a rider is seated on the bicycle. The rear wheel is held in a raised position by the stand such as to fully support the weight of the rider, causing the rear wheel to be freely rotatable, impeded essentially only by the inertia of the flywheel. The stand accomodates wheels of various diameters, and a manual control readily accessible to the seated rider permits selection of tire to spindle force no greater than that required to avoid slippage. The tire is also protected against damage by a flywheel brake which becomes effective in the event the bicycle brake is suddenly applied while there is still negative clearance between the flywheel and the spindle, and therefore, while the flywheel is still spinning.

10 Claims, 11 Drawing Figures

CYCLE SUPPORT FOR EXERCISING

This application is a continuation of application Ser. No. 339,625, filed 1/15/82 (abandoned) which was in turn a continuation of Ser. No. 136,173 filed 3/13/80 (abandoned).

Riders of bicycles are accustomed to the feelings which they experience as the result of inertia and momentum as they accelerate, coast, tour, shift gears and speed. Simulation of that feeling in an exercise apparatus requires the storage of energy when the riders exert extra effort, and the release of that stored energy when the riders desire to coast or pedal easily.

Such advantageous results cannot be accomplished through use of drag rollers as has been repeatedly suggested in virtually all such devices with which I am familiar. And, the disadvantages of those arrangements are multiplied appreciably when the rollers also support the weight of the rider. It is impossible to store any significant amount of energy in the rollers; therefore, when peddling is discontinued rotation of the driven bicycle wheel ceases rather quickly such that the sensation of coasting is virtually nonexistent.

The solution lies in transmitting the rotative power of the driven bicycle wheel directly and solely to a rotatable mass so that the inertia thereof can be readily detected by the rider as energy is stored therein. Thereupon, that energy of the spinning flywheel is utilized to drive the bicycle wheel for a considerable period of time after peddling is discontinued.

The manner in which those novel results are accomplished will be made clear as the following specification progresses, reference being had to the accompanying drawings wherein.

Figure 1:
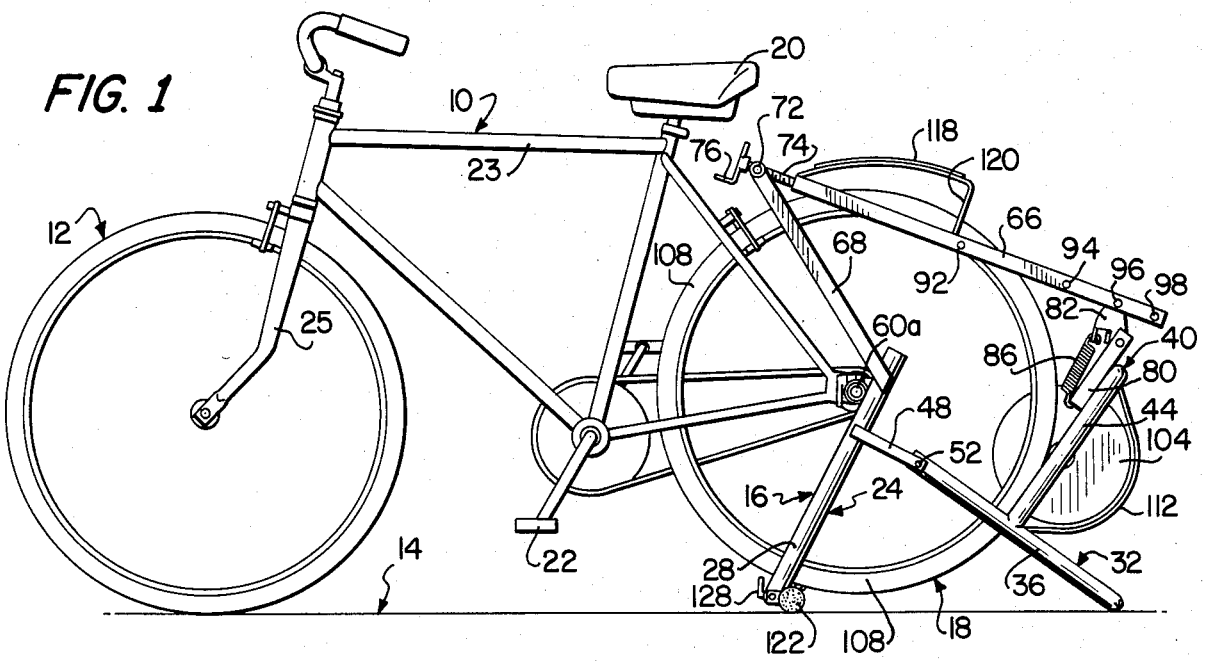
FIG. 1 is a side elevational view of a conventional bicycle showing the same on the support stand forming the subject matter of my present invention.
Figure 2:
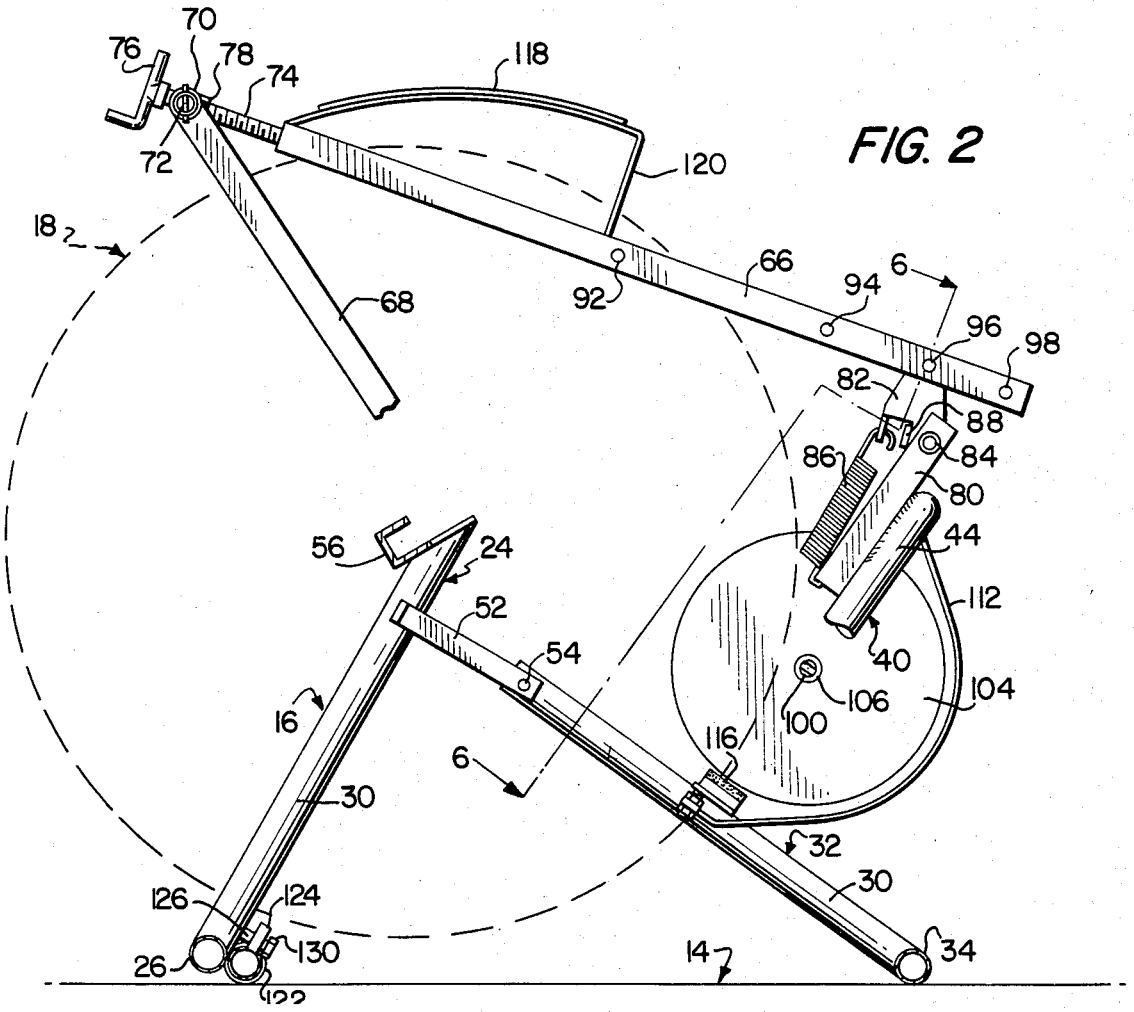
FIG. 2 is an enlarged, framentary, vertical cross-sectional view of the stand with the rear bicycle thereon in phantom outline.
Figure 4:
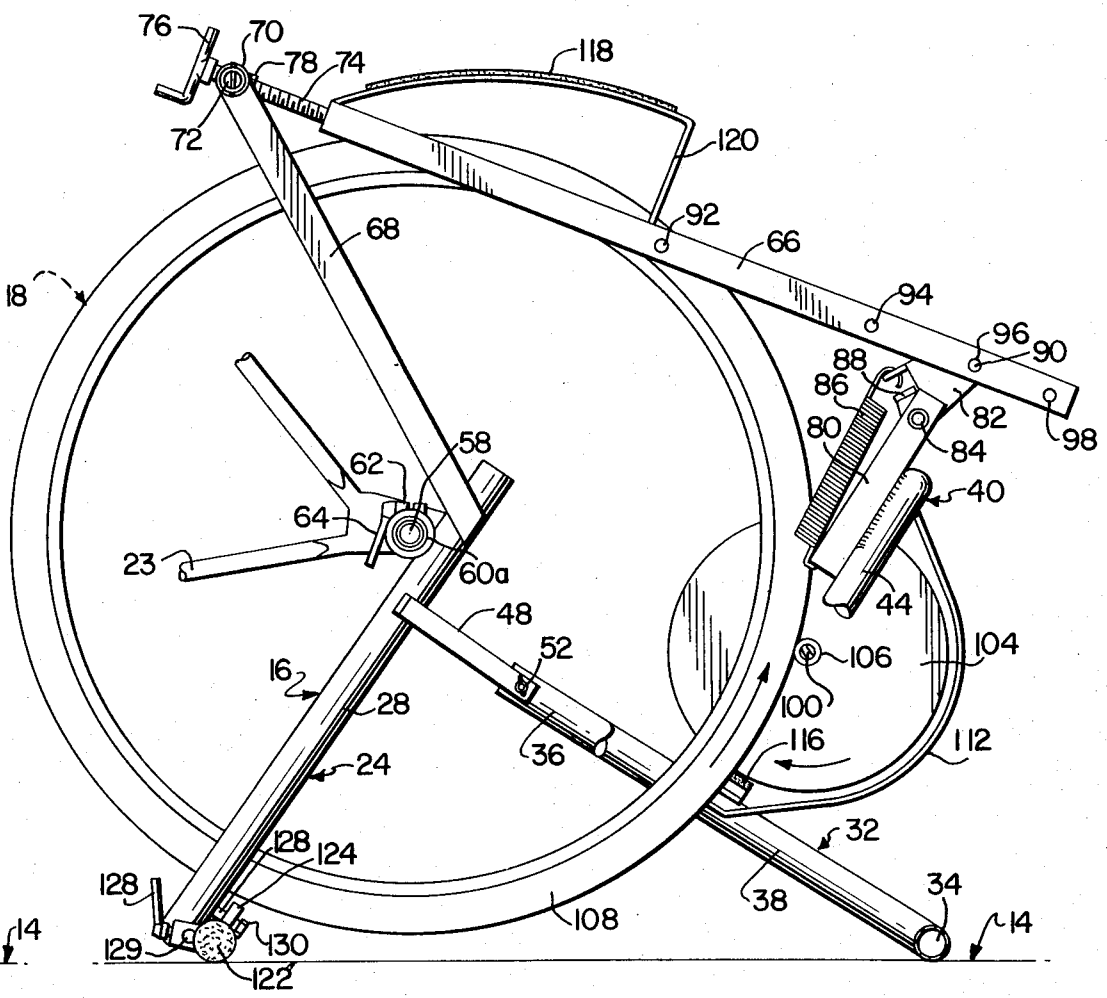
FIG. 4 is a view similar to FIG. 2 but illustrating the position of parts when a rider is on the bicycle.
Figure 3:
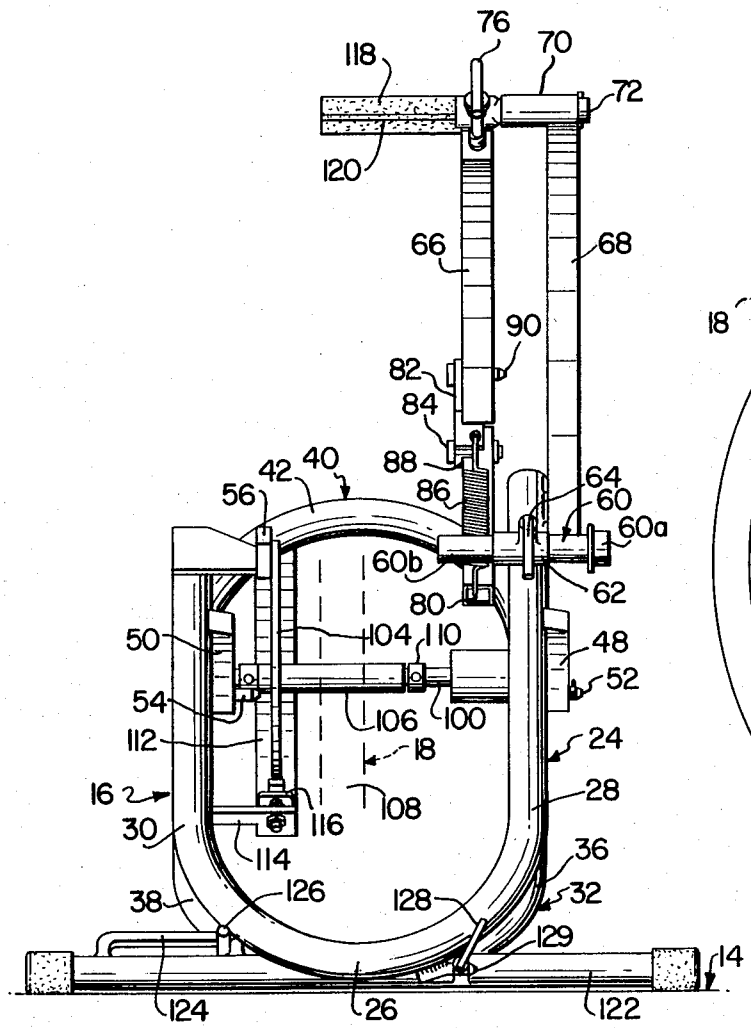
FIG. 3 is a front elevational view of the stand.
Figure 8:
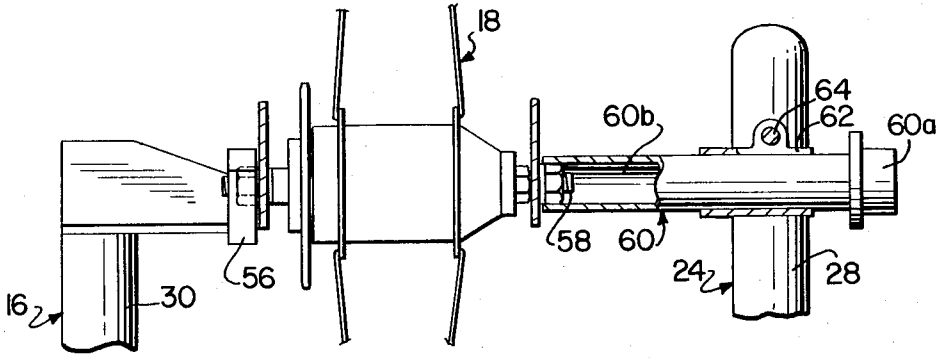
FIG. 8 is a fragmentary, front elevational view, still further enlarged, showing the attachment of the rear bicycle wheel to the stand, parts being broken away and in section for clearness.
Figure 5:
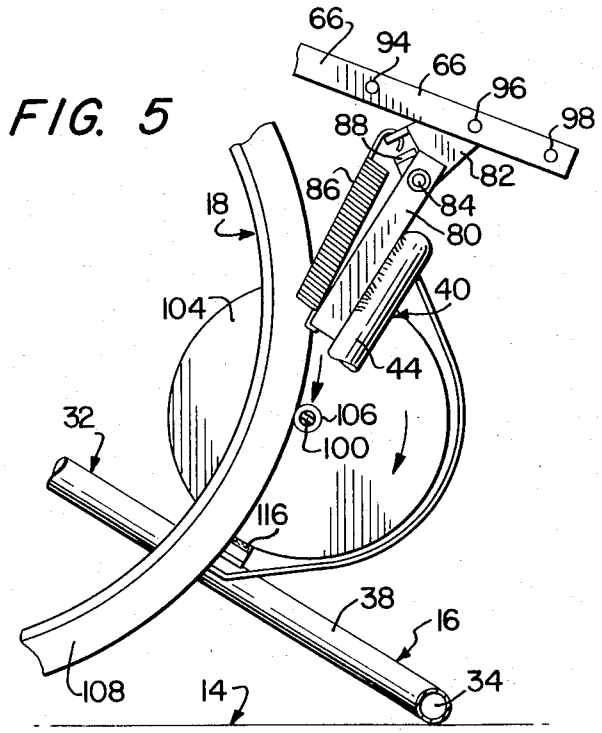
FIG. 5 is a fragmentary, side elevational view similar to FIG. 4, showing the energy storing inertia disc braked.
Figure 7:
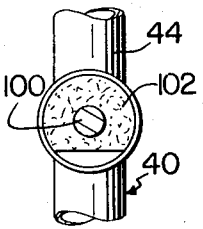
FIG. 7 is a fragmentary, detailed cross-sectional view taken on line 7—7 of FIG. 6.

I am familiar with and hereby make the following U.S. patents of record:

| | | |
|---|---|---|
| 2,261,846 | November, 1941 | Dollinger |
| 2,534,967 | December, 1950 | Hapman |

-continued

| | | |
|---|---|---|
| 3,107,915 | October, 1963 | Looney |
| 3,201,121 | August, 1965 | Locke |
| 3,905,597 | September, 1975 | Tabs |
| 4,021,034 | May, 1977 | Olesen |
| 4,082,265 | April, 1978 | Berkes |
| 4,082,308 | April, 1978 | Hug |

All of the above identified patents relate to bicycles and each utilizes a stand or other support for at least the rear wheel of the bicycle. The following also support the front wheel: U.S. Pat. Nos. 2,261,846; 3,905,597; 4,082,265 and 4,082,308. The rear wheel of the bicycle is supported by its axle in the first four patents above listed. The front bicycle remains at rest on the surface which supports the stand in all of the references except for 3,905,597 and 4,082,265, and in one embodiment of 2,261,846.

All of those prior patents have two rollers spaced fore and aft beneath and in engagement with the rear bicycle tire except for U.S. Pat. Nos. 2,261,846; 3,201,121 and 4,021,034. U.S. Pat. No. 2,261,846 discloses a single roller directly below the rear wheel axle.

In U.S. Pat. No. 3,201,121 the extent of rear wheel elevation is fixed and its tire engages a drag roller therebehind rotatably carried by the stand. But the roller can only be adjusted before use toward and away from the tire. A spring-loaded brake acting against the roller can only be adjusted prior to use so as to vary the amount of braking pressure exerted on the roller, while the apparatus is in use. In U.S. Pat. No. 4,021,034 the extent of rear wheel elevation is also fixed and its tire engages a drag roller in front of the tire. An adjustable jack supports the roller against undue downward flexing of the stand.

Hence, U.S. Pat. Nos. 3,201,121 and 4,021,034 become relevant only because the rear wheels are unsupported therebeneath and because of the location of the tire driven elements, particularly as shown in U.S. Pat. No. 4,021,034. But, in accordance with my instant invention, the weight of the rider is not permitted to bear heavily on the tire driven element as in U.S. Pat. No. 4,021,034 and I do not brake the driven element while it is being rotated as in U.S. Pat. No. 3,201,121. In accordance with my concepts, the use of drag rollers, as in all of the above references, is entirely eliminated.

I am also aware of two prior art exercisers which have been advertised for sale, one supporting a pedal operated, rear bicycle wheel which drives a so-called "wind load simulator" which appears to be in the nature of a small turbine or blower, and the other of which supports a front, pedal driven, bicycle-like wheel consisting essentially of a large diameter "cast-aluminum weighted flywheel".

In my invention a bicycle 10 is supported solely by its front wheel 12 at rest on an underlying surface 14 and by a collapsible stand 16 on the surface 14 which holds rear bicycle wheel 18 elevated, and therefore, spaced above the surface 14 such that the rear wheel 18 may be freely rotated by a rider on seat 20 operating treadle means which includes pedals 22. While the concepts hereinafter set forth will be described in relationship to the bicycle 10, it is to be understood that the front wheel 12 is unnecessary and that the wheel 18 need not be a "back" wheel of the framework 23 which supports the seat 20, it being necessary only to include the pedals 22 as a power transmitting medium on a frame for a driven wheel 18 and to support the fork 25 (or other portion of the framework 23) in any desired manner, not necessarily by a wheel.

The stand 15 has three U-shaped frame sections including a front bottom section or pedestal 24 provided with a bight 26 having a pair of upwardly and rearwardly extending legs 28 and 30; a rear bottom section 32 provided with a bight 34 having a pair of upwardly and forwardly extending legs 36 and 38; and a rear upper section 40 provided with a bight 42 and a pair of downwardly and forwardly extending legs 44 and 46 rigidly joined at their lower front ends to the legs 36 and 38 respectively intermediate the ends of the latter.

The legs 38 and 30 of the front section 24 have short downwardly and rearwardly extending arms 48 and 50 respectively rigid thereto intermediate their ends which are attached to the legs 36 and 38 of the rear section 32 by pivot pins 52 and 54 such that the sections 24 and 32 will buckle relatively about the pins 52 and 54, increasing and decreasing the distance between bights 26 and 24, in the manner and for the purposes hereinafter explained.

The rear wheel 18, disposed between the legs 28 and 30 of the front section 24 and between the legs 36 and 38 of the rear section 32, forwardly of the bight 42 of the upper section 40, forwardly of the bight 34 of the rear section 32 and spaced from the bight 26 of the front section 24, is carried by the legs 28 and 30 of the front section 24 above the arms 48 and 50. To this end, the upper end of the right leg 30 has a hook 56 which receives the right end nut of axle 58 of the rear wheel 18 and the left leg 28 has a horizontal tube 60 which receives the opposite end nut of the axle 58. Such end nuts on axle 58 are well known in the bicycle art, operated as opposed retention means for the wheel 18 to releasably hold it in place of the framework 23 of the bicycle 10. The tube 60 is shiftable in and out along a split clamp 62 which is rigid to the left leg 28 and is releasably held in place by a take-up bolt 64 forming a part of the clamp 62.

The sections 24 and 40 are interconnected by an elongated, inclined adjusting member 66 that is coupled at its upper forward end with the upper and forward end of an inclined element 68 which is, in turn, fixed at its lower end to the left leg 28 above the clamp 62. A lateral tube 70 rigid to the upper end of the element 68 rotatably receives an inner tube 72 through which loosely extends a bolt 74 provided with a hand crank 76. The bolt 74 is threaded into the upper end of the member 66 and the tube 72 is disposed between the crank 76 and a stop nut 78 on the bolt 74.

At the lower end of the member 66 there is provided a second element 80 inclined oppositely to the element 68 and rigidly attached to the left leg 44. A toggle 82 has pivotal connection 84 with the element 80, and a coil spring 86 interconnects the toggle 82 and the element 80 to yieldably bias the lower edge of a stop 88 (intergral with the toggle 82) against the element 80 under normal non-operating conditions. The upper edge of the stop 88 engages the element 80 when the spring 86 is under tension during use of the apparatus by a rider on the seat 20.

The member 66 has a series of holes any one of which is adapted to selectively receive a pivot pin 90 rigid to the toggle 82. For example, hole 92 is used for rear wheel 18 having 20 inch diameters, hole 94 is for wheels of 24 inch diameters, hole 96 is employed for wheels of 26 inch diameters (as shown in the drawings) and hole 98 is for wheels of 27 inch diameters.

Spanning the distance between the legs 44 and 46 of the rear section 40, as well above the surface 14, behind the rear wheel 18, is a transverse rod 100 carried by resilient vibration dampening mounts 102. A rotatable, relatively thin, circular energy storing member in the nature of a metal flywheel disc 104, disposed between the rear wheel 18 and the right leg 46, is provided with a rotatable driven element such as an integral, tubular spindle 106 engageable with the periphery of a pneumatic tire 108 of frictionable material on the rear wheel 18, and having a diameter appreciably less than that of the disc 104. The spindle 106 is freely rotatable on the rod 100 between a pair of set collars 110 secured to the rod 100.

An arcuate guard strip 112 partially encircling the disc 104 therebehind and therebelow has its rear, upwardmost end rigidly attached to the bight 42 of the rear section 40. The lower, forwardmost end of the strip 112 is carried by a lug 114 projecting inwardly from the right leg 48. Immediately above the lug 114 the strip 112 carries a brake 116 of fibrous, frictional material engageable with the circular periphery of the disc 104.

Any on of a number of additional safety devices may be provided, for example, a flexible shield 118 overlying the wheel 18 and carried by a bracket 120 on the member 66, and an elongated, transverse stabilizer 112, attached to the bight 26 of the front section 24 and resting on the surface 14.

OPERATION

The bicycle 10 is associated with the stand 16 by placement of the wheel 18 between the legs 28 and 30 and then inserting one nut of the axle 58 into the hook receptor 56, whereupon the tube receptor 60 is placed over the opposite nut on the axle 58 and locked in place by use of the bolt 64. The pin 90 is inserted into the appropriate hole 92–98, depending on the diameter of the rear wheel 18. The spring 86 normally maintains the tire 108 and the spindle 106 spaced apart with the lower edge of the stop 88 engaging the element 80.

Thereupon the weight of the rider mounting the seat 20 overcomes the action of the spring 86, swinging the toggle 82 until the upper edge of the stop 88 comes into engagement with the element 80. This precludes all further downward buckling of the stand 16 such that the entire weight of the rider is supported by the stand 16 rather than by any other component, such as rollers underlying the rear wheel 18.

The action which takes place as the rider mounts the seat 20 is such as to buckle the sections 24 and 32, lowering the pivots 52 and 54 and increasing the distance between the bights 26 and 34. Either or both of the bights 26 and 24 may well move in response to the rider's weight; but, for the most part, the stabilizer 122 tends to remain stationary as the bight 34 slides rearwardly along the surface 14.

In any event, the action is to exert a rearward push on the member 66, causing the swinging of the toggle 82 about the pivots 84 and 90 and causing the distance between the tire 108 and the spindle 106 to be decreased. Assuming the effective length of the member 16 to be correct, the tire 108 comes into tractive engagement with the spindle 106. However, because the crank 76 is readily accessible to the rider, it can be manipulated to increase or decrease the force between the tire 108 and the spindle 106 as needed to accomodate for the extent to which the tire 108 is fully inflated and to adjust to particular tire sizes. Tire protection is assured by providing only sufficient force to cause the wheel 18 to drive the spindle 106 without undue slippage during operation of the pedals 22.

When the rider dismounts there is an immediate release of power transmittal to the spindle 106 by virtue of the action of the spring 86 exerting a pull on the toggle 82 and causing a separation of the tire 108 and the spindle 106.

Inasmuch as the entire weight of the bicycle 10 and its rider is on the front wheel 12 and on the toggle 82, there is no downward component of force of the rear wheel 18 against anything therebeneath. Therefore, deterrent to free rotation of the rear wheel 18 is essentially limited to its own inertia and that of the disc 104.

At the outset then, as the inertia of the disc 104 is overcome, the rider has a feeling of acceleration the same as if he were accelerating on a flat road. As he pedals faster and faster he approaches his top speed capabilities. Or he may decrease his effort and pedal at a constant rate, simulating touring, or continue "racing" at his top capabilities.

Pedaling may be discontinued at any time and thereupon the rider has the feeling of coasting because the momentum of the disc 104 will operate to drive the rear wheel 18 for a considerable period of time.

Some riders have a tendency to needlessly apply the brakes of the bicycle 10 just before dismounting because of their feeling of actual riding. If that is done while the disc 104 is rotating at high speeds, there is too much energy in the mass of the disc 104 to cause it to stop quickly through the friction drive. The spindle 106 will continue to spin relative to the rear wheel 18, causing excessive damage to the tire 108. In that event, because of the resiliency of the mounts 102, the spindle 106 is pulled downwardly as it attempts to drive the stalling rear wheel 18 until the disc 104 engages the brake shoe 116, stopping the disc 104.

Not to be overlooked is the novelty of the open, yoke-like configuration of the frame sections 24, 32 and 40 accomodating all types of gearshifts, brakes and their controls which vary considerable among conventional bicycles. And, the arrangement is such as to permit quick and easy switching from one bicycle to another, all without any bicycle modification whatsoever because the hooks 56 and the tube 60 will receive the nuts on the outer ends of the axles 58 of all present day bicycles. The hook 56 is oversize to accomodate both large and small nuts on the outer ends of the axle 58. The reversible tube 60 has an end **60*a* with a large inside diameter and an end 60*b* with a smaller inside diameter to accomodate two ranges of nut sizes for axles 58**.

The spacing between the rear wheel 18 and the surface 14 remains substantially the same for all wheel sizes, and such spacing decreases only a very small amount when the rider mounts the seat 20. The open space beneath the rear wheel 18 is very important because it eliminates the dead, dragging type of load which is inherent in most of the prior art devices. Inasmuch as the precision balanced, high energy disc 104 can, therefore, be spun at very high speeds relative to the rate of rotation of the rear wheel 18 the operator is given the feeling of acceleration, coasting, speeding and touring while, at the same time, permitting the fuel of smooth shifting of the gears of the bicycle 10. The pure drudgery of the "dead-load" sensations heretofore suggested is totally absent.

In satisfactory testing of my invention a 4 and $\frac{1}{2}$ pound steel flywheel disc 104 was used, having a 9 inch diameter and a thickness of $\frac{1}{4}$ inch. It was secured to the spindle 106 having a $\frac{7}{8}$ inch outside diameter. Other 9 inch discs 104 were tried, but when the thickness was increased to $\frac{1}{2}$ inch or decreased to $\frac{1}{8}$ inch substantial effectiveness was lost. In this regard, the configuration of the flywheel 104 is, for the most part, of little significance. Inasmuch as storage of energy is the prime objective, it is the weight and distance from the center of rotation of the flywheel 104 to the center of that weight (radius of gyration) which are important because of the stepped up gearing between the spindle 106 and the tire 108, the speed of the center of the mass of the flywheel 104, measured at its radius of gyration, is appreciably greater than the peripheral speed of the tire 108.

It can be calculated that with a 30 pound bicycle, for example, operated over the road by a 130 pound rider, the kinetic energy developed at speeds of from 10 to 40 miles per hour will progressively increase from about 535 to 8,561 foot pounds. Through use of my improvements at those same rear wheel speeds, the stored energy will increase from about 796 to as great as approximately 12,736 foot pounds.

In further comparison, if a rear bicycle wheel 18 were coupled with a 5 inch blower, 3 inches long, to simulate wind, as hereinabove referred to, the energy thereby stored at those same speeds would range only between about 24 to 96 foot pounds.

Still further, if a roller system as suggested, for instance in U.S. Pat. No. 3,905,597, were operated under the same conditions and within the same speed range, the best that could be expected is little more than from about 42 to 667 foot pounds.

In summary, the flywheel 104 absorbs excess energy as soon as the energy expended by the cyclist is greater than the work required to rotate the rear wheel 18 and the spindle 106. The excess energy so absorbed by the flywheel 104 will cause it to progressively increase in speed as power is continuously applied to the pedals 22. Then, when the energy supplied to the flywheel 104 is discontinued, the rear wheel 18 will begin to rotate slower and slower as the flywheel 104 gives up its stored energy to supply the deficiency caused by discontinuance of further power supplied to the rear wheel 18 through actuation of the pedals 22.

It necessarily follows that the heavier the flywheel 104 and the greater its velocity, the greater the energy that may be stored up in the flywheel 104 and the less will be the change of speed for any given amount of stored energy, and my present invention cannot, therefore, be deemed to be limited to the shape, type, dimensions and weight for the flywheel 104 as above suggested by way of example. But, since I have chosen a flywheel of moderate weight, it is perhaps desirable that it normally be made from a solid metal.

It is to be recognized that in apparatus of the kind above described, and in all those suggested by the prior art, it is not possible to fully attain all of the same top efficiencies as those which are usually possible through use of most bicycles when ridden normally over the road. However, even if it could be said that a flywheel effect is possible in any of the prior art suggestions, such effect therein is insignificant when compared with that which results from the use of my improvements. Many modern bicycles are provided with gear shift mechanism manually operable by the cyclist. In the event the slight imperfect efficiencies are detectable by the rider of my exerciser, he need merely shift to a lower gear whereupon the lack of absolute perfection will become unnoticeable.

Figure 6:
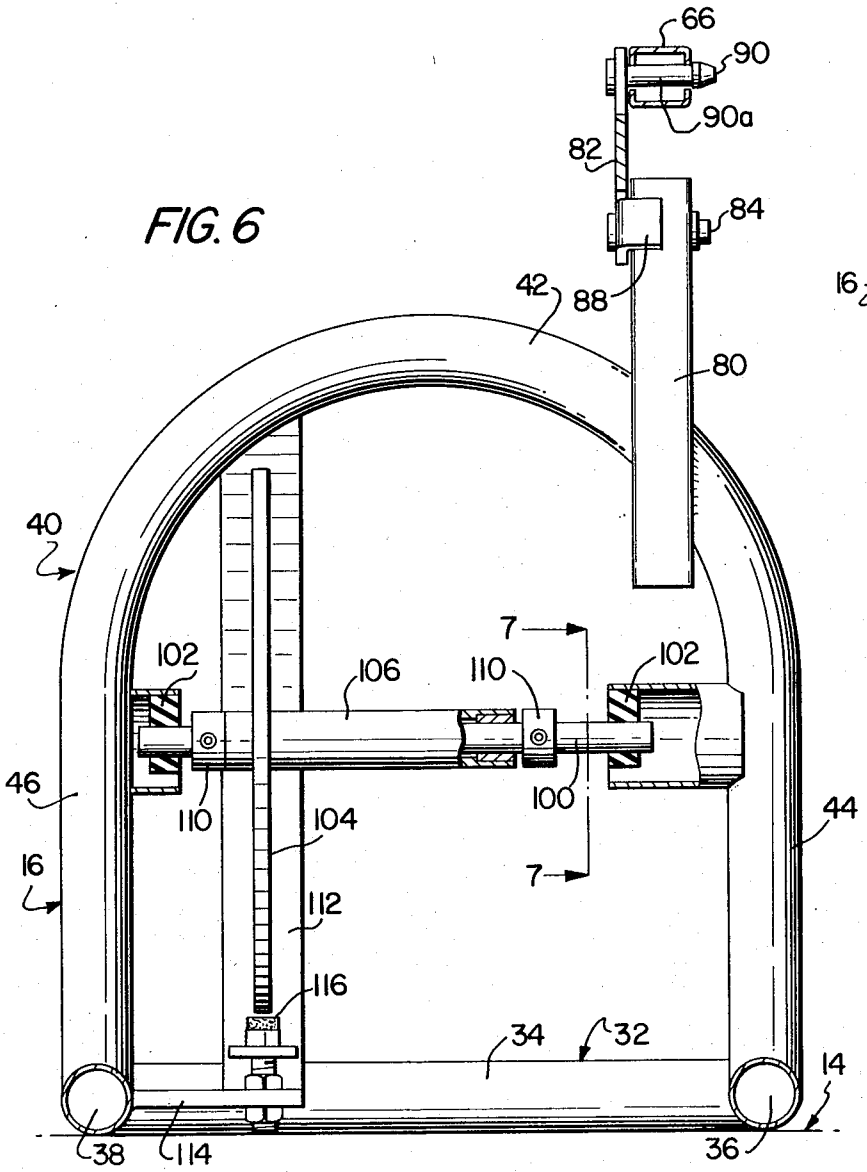
FIG. 6 is a cross-sectional view taken on irregular lines 6—6 of FIG. 2, parts being broken away and in section to reveal details of construction.
Figure 9:
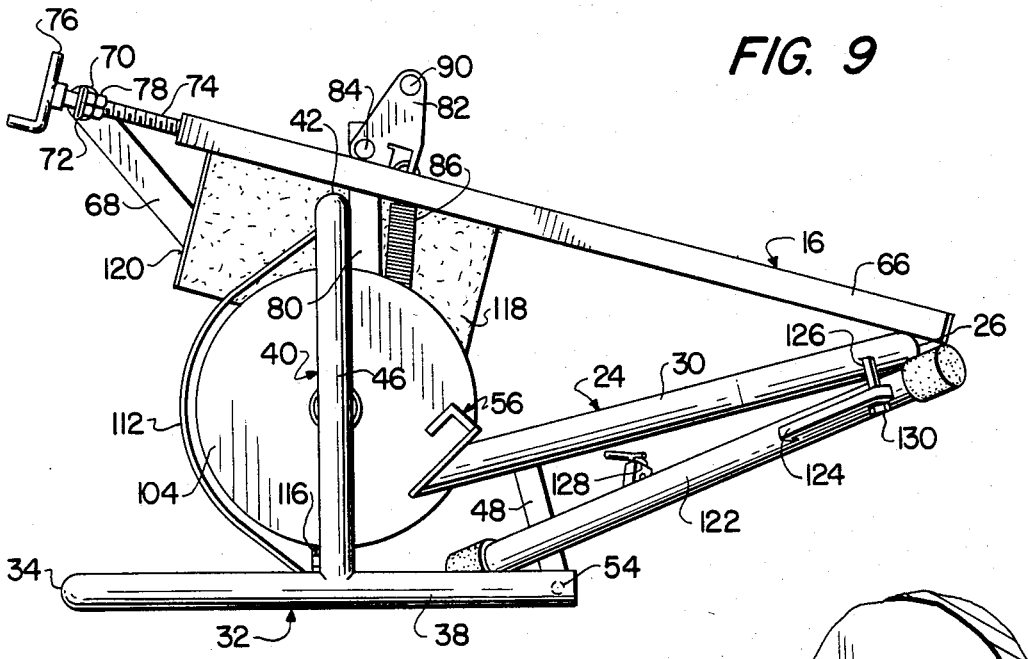
FIG. 9 is a side elevational view of the stand in its collaped condition.
Figure 10:
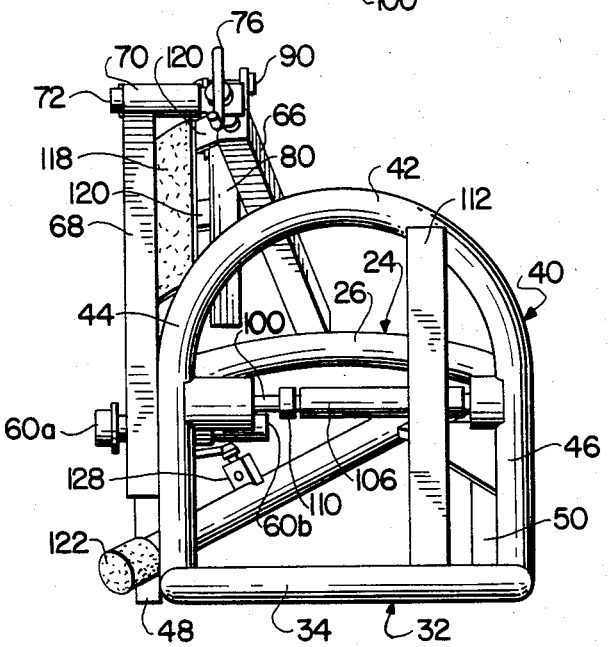
FIG. 10 is a rear end view of the collapsed stand.

The stand 16 is collapsible to the condition shown in FIGS. 9 and 10 (following which the bight 42 becomes a carrying handle) made possible first because the member 66 is removable from the pivot 90, normally held in position by undercut 90*a* in the pin 90 as shown in FIG. 6. Additionally, the stabilizer 122 has a loop 124 which receives a stud 126 welded to the leg 30 adjacent the bight 26. Upon release of a set collar 128 on the atabilizer 122 receiving a pin 129 welded to the bight 26, the stabilizer 122 may be swung to the position shown in FIGS. 9 and 10.

The pivots 52 and 54 permit the section 32 to be laid over horizontally (now serving as a base) with the section 40 extending upwardly therefrom. The section 24 swings downwardly and rearwardly, supported by the section 32 therebelow by the arms 48 and 50; the member 66 simply lies upon the bight 26; and the stabilizer 122 rests across the leg 38 adjacent the arm 48. To be noted if the fact that the member 66 has been rotated 180° about the axis of the tube 70 prior to being placed on the bight 26, and that the bracket 120 has been looped over the element 80 such that the shield 118 hangs between the leg 44 and element 68.

The pivot 52 has an undercut (not shown) similar to the undercut 90*a*. Thus, for breakdown, to simplify packaging and shipment, the section 32 may be slipped off the pivots 52 and 54 such as to become a separate piece. The spring 86 is also easily removed, and the member 66 may be disassociated from the element 68 by turning the bolt 74 out of the proximal end of the member 66. Also, by removal of a nut 130 on the stud 126, the stabilizer 122 may be removed from the section 24.

Figure 11:
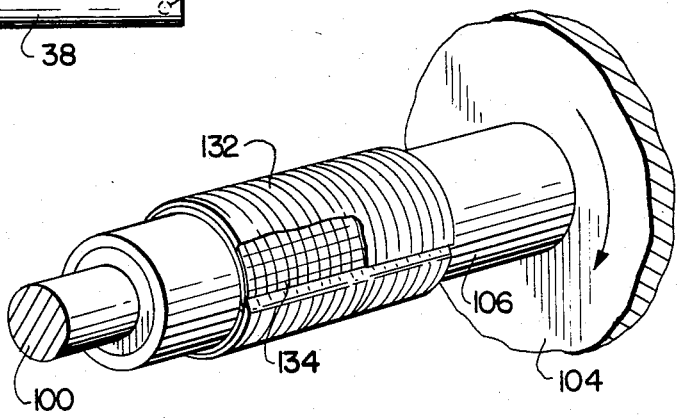
FIG. 11 is an enlarged, fragmentary, perspective view showing the hub of the inertia disc provided with a renewable, tire-engaging band therearound.

Efficiency of the flywheel disc 106 can be improved, as shown in FIG. 11, by wrapping a renewable band 132 around the spindle 106 for engagement with the tire 108. Any suitable adhesive tape material may be used for such purpose capable of bonding firmly to the spindle 106. The outer surface of the band 132 should not be abrasive to the tire 108 but needs to be somewhat frictionable to avoid slippage when crank 76 is adjusted in a direction to provide for negative spacing between the tire 108 and the band 132. Thus, the required force between the tire 108 and the band 132 needed to effect proper rotation of the spindle 106 and the disc 104 can be reduced, providing for easier pedaling and longer "coasting" periods.

By the way of example only, there is a so-called plastic "duct tape" readily available on the open market which has been found suitable for the band 132. It is usually reinforced by a nylon mesh 134 imbedded therein and, because of the resiliency of the band 132, the squeezing of the tire 108 against the band 132 tends to cause the mesh 134 to prevent relative slippage between the tire 108 and the outer surface of the band 132.

What I claim is:

1. In an exerciser for simulating bicycling:

framework having pedal means and a driven wheel propelled in response to foot power exerted on the pedal means by a rider mounted on the framework, said wheel having an axle;

a stand adapted to rest on a supporting surface therefor;

an energy storing, inertia member spaced above said surface alongside the wheel and having a rotatable driven element extending therethrough and fixed thereto, said member and said element having a common axis of rotation;

mounting means attaching the element to the stand for rotation of the member and the element about said axis; and connecting means on the stand attaching said axle thereto and holding the wheel suspended above and out of engagement with said surface and rotation about an axis in parallelism with said common axis of the member and element, said element being disposed for rolling engagement with the periphery of the wheel whereby rotative power is transmitted to the element from the wheel during rotation of the wheel by said pedal means, said mounting means including a pair of spaced, resilient, vibration dampening mounts carried by the stand, said element having means extending through the mounts.

2. In an exerciser for simulating bicycling:

framework having pedal means and a driven wheel propelled in response to foot power exerted on the pedal means by a rider mounted on the framework, said wheel having an axle;

a stand adapted to rest on a supporting surface therefor;

an energy storing, inertia member spaced above said surface alongside the wheel and having a rotatable driven element extending therethrough and fixed thereto, said member and said element having a common axis of rotation;

mounting means attaching the element to the stand for rotation of the member and the element about said axis;

connecting means on the stand attaching said axle thereto and holding the wheel suspended above and out of engagement with said surface and rotation about an axis in parallelism with said common axis of the member and element, said element being disposed for rolling engagement with the periphery of the wheel whereby rotative power is transmitted to the element from the wheel during rotation of the wheel by said pedal means, said mounting means including a pair of resilient vibration dampening mounts on the stand carrying said element;

means operable by the rider on the framework for braking said wheel;

and a device on the stand for retarding motion of said member, said mounts yielding for movement of the member into frictional engagement with said device upon sudden operation of said braking means by the rider on the framework while the member is spinning.

3. In an exerciser for simulating bicycling:

framework having pedal means and a driven wheel propelled in response to foot power exerted on the pedal means by a rider mounted on the framework, said wheel having an axle;

a stand adapted to rest on a supporting surface therefor;

an energy storing, inertia member spaced above said surface alongside the wheel and having a rotatable driven element extending therethrough and fixed thereto, said member and said element having a common axis of rotation;

mounting means attaching the element to the stand for rotation of the member and the element about said axis; and connecting means on the stand attaching said axle thereto and holding the wheel suspended above and out of engagement with said surface and rotation about an axis in parallelism with said common axis of the member and element, said element being disposed for rolling engagement with the periphery of the wheel whereby rotative power is transmitted to the element from the wheel during rotation of the wheel by said pedal means, said wheel having an axle-receiving hub, said connecting means including a tube for receiving one of said ends of the axle, said tube being shiftable on the stand toward and away from the wheel for accommodating hubs of differing lengths.

4. The invention of claim 3, said connecting means being provided with hook means on the stand receiving the other of said ends of the axle.

5. The invention of claim 3; and releasable means on the stand for holding the tube against movement relative to the stand.

6. In an exerciser for simulating bicycling:

framework having pedal means and a driven wheel propelled in response to foot power exerted on the pedal means by a rider mounted on the framework, said wheel having an axle;

a stand adapted to rest on a supporting surface therefor;

an energy storing, inertia member spaced above said surface alongside the wheel and having a rotatable driven element extending therethrough and fixed thereto, said member and said element having a common axis of rotation;

mounting means attaching the element to the stand for rotation of the member and the element about said axis;

connecting means on the stand attaching said axle thereto and holding the wheel suspended above and out of engagement with said surface and rotation about an axis in parallelism with said common axis of the member and element, said element being disposed for rolling engagement with the periphery of the wheel whereby rotative power is transmitted to the element from the wheel during rotation of the wheel by said pedal means, said axle being provided with opposed wheel retention means, said connecting means including a tube for receiving one of said retention means; and releasable means attaching the tube to the stand, said tube being provided with a pair of opposed end openings, said openings being of differing sizes such that one opening will receive a retention means of one size and the other opening will receive a retention means of another size.

7. The invention of claim 6, said tube being shiftable on the stand toward and away from the wheel upon release of said releasable means for accommodating axles of differing lengths.

8. In an exerciser for simulating bicycling:

framework having pedal means and a driven wheel propelled in response to foot power exerted on the pedal means by a rider mounted on the framework, said wheel having an axle;

a stand adapted to rest on a supporting surface therefor;

an energy storing, inertia member spaced above said surface alongside the wheel and having a rotatable driven element extending therethrough and fixed thereto, said member and said element having a common axis of rotation;

mounting means attaching the element to the stand for rotation of the member and the element about said axis;

connecting means on the stand attaching said axle thereto and holding the wheel suspended above and out of engagement with said surface and rotation about an axis in parallelism with said common axis of the member and element, said element being disposed for rolling engagement with the periphery of the wheel whereby rotative power is transmitted to the element from the wheel during rotation of the wheel by said pedal means;

a control disposed for ready accessibility to the rider on said framework and manipulable manually during operation of the pedal means for shifting the wheel and element relatively toward and away from each other to permit rider selection of a wheel-to-element interengaging force sufficient only to avoid relative slippage of the wheel and the element during rotation of the element by the wheel, said mounting means including a pair of resilient vibration dampening mounts on the stand having means carrying said element;

means operable by the rider on the framework for braking said wheel;

and a device on the stand for retarding motion of said member, said mounts yielding to movement of the member into frictional engagement with said device upon sudden operation of said braking means by the rider on the framework while the member is spinning.

9. In an exerciser for simulating bicycling:

framework having pedal means and a driven wheel propelled in response to foot power exerted on the pedal means by a rider mounted on the framework, said wheel having an axle;

a stand adapted to rest on a supporting surface therefor;

an energy storing, inertia member spaced above said surface alongside the wheel and having a rotatable driven element extending therethrough and fixed thereto, said member and said element having a common axis of rotation;

mounting means attaching the element to the stand for rotation of the member and the element about said axis; and connecting means on the stand attaching said axle thereto and holding the wheel suspended above and out of engagement with said surface and rotation about an axis in parallelism with said common axis of the member and element, said element being disposed for rolling engagement with the periphery of the wheel whereby rotative power is transmitted to the element from the wheel during rotation of the wheel by said pedal means, said stand being provided with a pedestal swingable toward and away from said element about an axis disposed in spaced parallelism with said common axis and said axis of rotation of the wheel for rendering said periphery of the wheel movable toward and away from said element, whereby rolling engagement is established between the periphery of the wheel and said element in response to the weight of the rider on said framework.

10. The invention of claim 9; and resilient means for swinging the pedestal away from said element when the rider dismounts the framework to move said wheel periphery out of engagement with the element.

* * * * *